US010458021B2

(12) United States Patent
Terashima et al.

(10) Patent No.: US 10,458,021 B2
(45) Date of Patent: Oct. 29, 2019

(54) TREATMENT SOLUTION FOR CHROMIUM-FREE TENSION COATING, METHOD FOR FORMING CHROMIUM-FREE TENSION COATING, AND GRAIN ORIENTED ELECTRICAL STEEL SHEET WITH CHROMIUM-FREE TENSION COATING

(71) Applicant: JFE STEEL CORPORATION, Tokyo (JP)

(72) Inventors: Takashi Terashima, Tokyo (JP); Makoto Watanabe, Tokyo (JP); Masanori Uesaka, Tokyo (JP); Ryuichi Suehiro, Tokyo (JP); Toshito Takamiya, Tokyo (JP)

(73) Assignee: JFE STEEL CORPORATION, Tokyo (JP)

( * ) Notice: Subject to any disclaimer, the term of this patent is extended or adjusted under 35 U.S.C. 154(b) by 0 days.

(21) Appl. No.: 16/117,369

(22) Filed: Aug. 30, 2018

(65) Prior Publication Data

US 2018/0371620 A1 Dec. 27, 2018

Related U.S. Application Data

(62) Division of application No. 15/038,501, filed as application No. PCT/JP2015/000139 on Jan. 14, 2015, now Pat. No. 10,087,529.

(30) Foreign Application Priority Data

Jan. 31, 2014 (JP) ..... 2014-017816

(51) Int. Cl.

| | |
|---|---|
| ***C23C 22/12*** | (2006.01) |
| ***C23C 22/18*** | (2006.01) |
| ***C23C 22/20*** | (2006.01) |
| ***C23C 22/22*** | (2006.01) |
| ***C23C 22/74*** | (2006.01) |
| ***C23C 22/78*** | (2006.01) |
| ***C21D 8/12*** | (2006.01) |
| ***C21D 6/00*** | (2006.01) |
| ***C21D 9/46*** | (2006.01) |
| ***H01F 1/18*** | (2006.01) |

(52) U.S. Cl.

CPC ..... *C23C 22/12* (2013.01); *C21D 6/008* (2013.01); *C21D 8/1288* (2013.01); *C21D 9/46* (2013.01); *C23C 22/182* (2013.01); *C23C 22/188* (2013.01); *C23C 22/20* (2013.01); *C23C 22/22* (2013.01); *C23C 22/74* (2013.01); *C23C 22/78* (2013.01); *H01F 1/18* (2013.01)

(58) Field of Classification Search

None

See application file for complete search history.

(56) References Cited

U.S. PATENT DOCUMENTS

| | | | | |
|---|---|---|---|---|
| 3,856,568 | A | 12/1974 | Tanaka et al. | |
| 3,985,583 | A | 10/1976 | Shimanaka et al. | |
| 6,602,357 | B2 | 8/2003 | Senda et al. | |
| 8,409,370 | B2 | 4/2013 | Takashima et al. | |
| 10,087,529 | B2 * | 10/2018 | Terashima | C21D 8/1288 |
| 2008/0190520 | A1 | 8/2008 | Watanabe et al. | |
| 2009/0032144 | A1 | 2/2009 | McMillen et al. | |
| 2010/0206437 | A1 | 8/2010 | Takashima et al. | |
| 2011/0041957 | A1 | 2/2011 | Brouwer et al. | |
| 2016/0060465 | A1 | 3/2016 | Sundermeier et al. | |
| 2017/0137633 | A1 | 5/2017 | Terashima et al. | |
| 2018/0033529 | A1 * | 2/2018 | Takeda | B32B 7/02 |
| 2018/0080127 | A1 | 3/2018 | Terashima et al. | |
| 2018/0087158 | A1 | 3/2018 | Terashima et al. | |
| 2018/0230565 | A1 * | 8/2018 | Watanabe | C21D 9/46 |
| 2018/0251899 | A1 * | 9/2018 | Terashima | C21D 9/46 |

(Continued)

FOREIGN PATENT DOCUMENTS

| | | | |
|---|---|---|---|
| JP | S53-28375 | B2 | 8/1978 |
| JP | S54-143737 | A | 11/1979 |
| JP | S56-52117 | B2 | 12/1981 |

(Continued)

OTHER PUBLICATIONS

English translation of the Written Opinion of the International Search Authority dated Mar. 3, 2015 for PCT/JP2015/000139; 4 pages.*

(Continued)

*Primary Examiner* — Helene Klemanski

(74) *Attorney, Agent, or Firm* — Oliff PLC

(57) ABSTRACT

Provided is a treatment solution for chromium-free tension coating that can simultaneously achieve excellent moisture absorption resistance and a high iron loss reduction effect obtained by imparting sufficient tension, by using an inexpensive Ti source instead of expensive Ti chelate. The treatment solution for chromium-free tension coating contains: one or more of phosphates of Mg, Ca, Ba, Sr, Zn, Al, and Mn; colloidal silica in an amount of 50 parts by mass to 120 parts by mass per 100 parts by mass of the phosphate in terms of solid content of $SiO_2$; Ti source in an amount of 30 parts by mass to 50 parts by mass per 100 parts by mass of the phosphate in terms of solid content of $TiO_2$; and $H_3PO_4$, and the number of moles of metallic elements in the phosphate and of phosphorus in the treatment solution satisfy:

$$0.20 \leq ([Mg]+[Ca]+[Ba]+[Sr]+[Zn]+[Mn]+1.5[Al])/[P] \leq 0.45 \quad (1).$$

3 Claims, No Drawings

(56) References Cited

U.S. PATENT DOCUMENTS

| | | | | |
|---|---|---|---|---|
| 2018/0371621 | A1* | 12/2018 | Terashima | C21D 8/1288 |
| 2019/0186018 | A1* | 6/2019 | Takeda | C22C 38/00 |

FOREIGN PATENT DOCUMENTS

| | | | |
|---|---|---|---|
| JP | S57-9631 | B2 | 2/1982 |
| JP | 2000-169972 | A | 6/2000 |
| JP | 2000-169973 | A | 6/2000 |
| JP | 2000-178760 | A | 6/2000 |
| JP | 2002-249881 | A | 9/2002 |
| JP | 2007-023329 | A | 2/2007 |
| JP | 2008-266743 | A | 11/2008 |
| JP | 2008-303411 | A | 12/2008 |
| JP | 2009-057591 | A | 3/2009 |

OTHER PUBLICATIONS

Mar. 3, 2015 International Search Report issued in International Patent Application No. PCT/JP2015/000139.

* cited by examiner

TREATMENT SOLUTION FOR CHROMIUM-FREE TENSION COATING, METHOD FOR FORMING CHROMIUM-FREE TENSION COATING, AND GRAIN ORIENTED ELECTRICAL STEEL SHEET WITH CHROMIUM-FREE TENSION COATING

This is a divisional of Ser. No. 15/038,501 filed May 23, 2016, now U.S. Pat. No. 10,087,529, which is a National Stage Application of PCT/JP2015/000139 filed Jan. 14, 2015, and claims the benefit of Japanese Application No. 2014-017816 filed Jan. 31, 2014. The entire disclosures of the prior applications are hereby incorporated by reference in their entirety.

TECHNICAL FIELD

The disclosure relates to a treatment solution for chromium-free tension coating. In particular, the disclosure relates to a treatment solution for chromium-free tension coating that can form tension coating with excellent moisture absorption resistance equivalent to that of tension coating containing chromium.

Further, the disclosure relates to a method for forming chromium-free tension coating using the above treatment solution for chromium-free tension coating, and to a grain oriented electrical steel sheet with chromium-free tension coating, the chromium-free tension coating being formed using the above treatment solution for chromium-free tension coating.

BACKGROUND

On the surface of the grain oriented electrical steel sheet, coating is generally applied for the purpose of imparting insulation properties, workability, rust resistance and the like. Such coating comprises a base film mainly composed of forsterite formed during final annealing and a phosphate-based top coating formed thereon.

These coatings are formed at a high temperature, and have a low thermal expansion coefficient. Therefore, when the steel sheet temperature is lowered to room temperature, tension resulting from the difference between the thermal expansion coefficient of the steel sheet and those of the coatings is imparted to the steel sheet. This tension provides an effect of reducing iron loss, and therefore it is desirable to impart as much tension as possible to the steel sheet.

To satisfy such demands, various types of coatings have been conventionally proposed. For example, JPS5652117B (PTL 1) describes a coating mainly composed of magnesium phosphate, colloidal silica, and chromic anhydride. Further, JPS5328375B (PTL 2) describes a coating mainly composed of aluminum phosphate, colloidal silica, and chromic anhydride.

Meanwhile, due to the growing interest in environmental preservation in recent years, there has been an increasing demand for products containing no harmful substances such as chromium, lead and the like. There has been a demand for development of coating containing no chromium i.e. chromium-free coating in the field of grain oriented electrical steel sheets as well. However, chromium-free coating has low moisture absorption resistance and poor tension imparting performance.

As methods for resolving the above problems, coating formation methods using treatment solutions containing colloidal silica, aluminum phosphate, boric acid, and sulfate were proposed in JPS54143737B (PTL 3) and JPS579631B (PTL 4). With these methods, it is possible to improve characteristics of the coating, i.e. the moisture absorption resistance and the iron loss reduction effect obtained by imparting tension to some degree. However, the characteristics were insufficient compared to conventional coating containing chromium.

Under the situation, various methods were proposed for the purpose of further improving coating characteristics. For example, an attempt was made for a method of increasing the amount of colloidal silica contained in the treatment solution for forming the coating. With said method, the tension imparting performance of the obtained coating was improved. However, the moisture absorption resistance decreased.

An attempt was also made for a method of increasing the additive amount of sulfate. However, with this method, although the moisture absorption resistance of the coating was improved, the tension imparting performance decreased, and a sufficient iron loss reduction effect could not be obtained. As described above, neither of the methods could improve both moisture absorption resistance and tension imparting performance to the necessary level.

As chromium-free coating formation methods other than the above, a method of adding a boric acid compound instead of a chromium compound has been proposed in JP2000169973A (PTL 5), a method of adding an oxide colloid has been proposed in JP2000169972A (PTL 6), and a method of adding a metal organic acid salt has been proposed in JP2000178760A (PTL 7).

However, even by using any of these techniques, it was not possible to enhance both the moisture absorption resistance and the iron loss reduction effect obtained by imparting tension, to the same level as conventional coating containing chromium, and these techniques could not be perfect solutions.

Further, JP200723329A (PTL 8) and JP200957591A (PTL 9) describe techniques similar in some respects to that of the disclosure. PTL 8 describes a technique of containing metallic elements such as Fe, Al, Ga, Ti, Zr and the like in the treating solution for forming the coating for the purpose of preventing hydration. PTL 9 describes a technique of improving moisture absorption resistance of the coating by adding Ti chelate to the treatment solution for forming the coating.

CITATION LIST

Patent Literature

PTL 1: JPS5652117B
PTL 2: JPS5328375B
PTL 3: JPS54143737B
PTL 4: JPS579631B
PTL 5: JP2000169973A
PTL 6: JP2000169972A
PTL 7: JP2000178760A
PTL 8: JP200723329A
PTL 9: JP200957591A

SUMMARY

Technical Problem

However, the coating obtained by the method described in PTL 8 has poor long-term moisture absorption resistance.

Further, the method described in PTL 9 has a problem in that the costs increase due to the use of Ti chelate, which is expensive.

This disclosure has been developed in light of the above circumstances. It could be helpful to provide a treatment solution for chromium-free tension coating that can simultaneously achieve excellent moisture absorption resistance and a high iron loss reduction effect obtained by imparting sufficient tension, by using an inexpensive Ti source instead of expensive Ti chelate.

It could also be helpful to provide a method for forming a chromium-free tension coating using the above treatment solution for chromium-free tension coating, and further, a grain oriented electrical steel sheet having chromium-free tension coating attached thereto with chromium-free tension coating formed using the above treatment solution for chromium-free tension coating.

Solution to Problem

In order to solve the above problems and achieve a desirable moisture absorption resistance and an iron loss reduction effect obtained by imparting tension using a chromium-free coating, we made intensive research and studies.

As a result, it was revealed that the reason the coating obtained by the method described in PTL 8 has poor long-term moisture absorption resistance is that the contents of metallic compounds such as Fe, Al, Ga, Ti, and Zr are not sufficient. Considering that, with the contents in the coating being the same, Ti has the second highest effect of improving moisture absorption resistance after Cr, an attempt was made to further increase the Ti content in the technique described in PTL 8.

As a result, it was revealed that adding a large amount of Ti causes crystallization of the coating, as well as a decrease in tension and cloudiness in the color tone of the coating both resulting from said crystallization of the coating.

In view of the above, we focused on Ti and made intensive studies on methods for further increasing the Ti content while avoiding crystallization. As a result, we discovered that by using a treatment solution containing a metal phosphate and phosphoric acid, and controlling the ratio (M/P) of the total number of moles of metal in the metal phosphate obtained from a certain formula (M) to the number of moles of phosphorus in the treatment solution (P), the Ti content can be increased with no difficulty and none of the above harmful influences, and completed the disclosure.

We thus provide:

1. A treatment solution for chromium-free tension coating containing:

one or more of a Mg phosphate, Ca phosphate, Ba phosphate, Sr phosphate, Zn phosphate, Al phosphate, and Mn phosphate;

colloidal silica in an amount of 50 parts by mass to 120 parts by mass per 100 parts by mass of the one or more phosphates in terms of solid content of $SiO_2$;

Ti source in an amount of 30 parts by mass to 50 parts by mass per 100 parts by mass of the one or more phosphates in terms of solid content of $TiO_2$; and $H_3PO_4$, and the number of moles of metallic elements in the one or more phosphates and the number of moles of phosphorus in the treatment solution for chromium-free tension coating satisfy the relation of formula (1)

$$0.20 \leq ([Mg]+[Ca]+[Ba]+[Sr]+[Zn]+[Mn]+1.5[Al])/[P] \leq 0.45 \quad (1)$$

where each symbol of element shown in square brackets represents the number of moles of the element contained in the treatment solution for chromium-free tension coating.

2. The treatment solution for chromium-free tension coating according to aspect 1, wherein the Ti source contains $TiO_2$ sol.

3. The treatment solution for chromium-free tension coating according to aspect 2, wherein the Ti source further contains titanium phosphate in a solid mass ratio of 0.1% to 50% with respect to $TiO_2$ in the $TiO_2$ sol.

4. A method of forming a chromium-free tension coating comprising:

applying a treatment solution according to any one of aspects 1 to 3 on a surface of a grain oriented electrical steel sheet subjected to final annealing; and performing baking treatment at a temperature of 800° C. or higher and 1000° C. or lower for 10 seconds to 300 seconds.

5. A grain oriented electrical steel sheet with chromium-free tension coating obtainable by applying a treatment solution according to any one of aspects 1 to 3 on a surface of a grain oriented electrical steel sheet subjected to final annealing and performing baking treatment at a temperature of 800° C. or higher and 1000° C. or lower for 10 seconds to 300 seconds.

Advantageous Effect

Chromium-free tension coating that provides excellent moisture absorption resistance for a long period and has a sufficient tension imparting effect can be obtained without using expensive Ti chelate.

Therefore, grain oriented electrical steel sheets with both excellent moisture absorption resistance and low iron loss can be obtained at low cost.

DETAILED DESCRIPTION

Hereinbelow, reference will be made to the experimental results which served as the basis of the disclosure.

First, samples were produced in the following way.

Grain oriented electrical steel sheets subjected to final annealing with sheet thickness of 0.23 mm which were produced by a conventional method were sheared into a size of 300 mm×100 mm to obtain sample pieces. The unreacted annealing separator remaining on the surfaces of the sample pieces were removed and then the sample pieces were subjected to stress relief annealing at 800° C. for 2 hours.

The sample pieces were then subjected to light pickling with 5% phosphoric acid, and then a treatment solution for tension coating was applied on the surfaces of the sample pieces. The treatment solution for tension coating was prepared by the following procedures. First, an aqueous solution of primary magnesium phosphate ($Mg(H_2PO_4)_2$), colloidal silica, and $TiO_2$ sol were mixed to obtain a mixed solution. The mass ratios of each component in the mixed solution were set to be, in terms of solid content, primary magnesium phosphate: 30 g, colloidal silica: 20 g, and $TiO_2$ sol: 12 g. Then, an aqueous solution of orthophosphoric acid ($H_3PO_4$) having a specific gravity of 1.69 with a concentration of 85% was added to the mixed solution in the amounts shown in Table 1 to obtain treatment solutions for tension coating. The ratios of the numbers of moles of $Mg^{2+}$ to the numbers of moles of phosphorus (total number of moles of phosphorus derived from both phosphate and phosphoric acid) (P) in the obtained treatment solutions for tension coating i.e. $Mg^{2+}/P$ were set to be the values shown in Table 1.

The treatment solutions for tension coating were applied on the surfaces of the sample pieces so that the total coating amounts of both surfaces after drying were 10 g/m$^2$. Then, the sample pieces were charged into the drying furnace and dried at 300° C. for 1 minute, and then subjected to heat treatment at 800° C. for 2 minutes in an atmosphere of $N_2$: 100% for the purpose of both flattening annealing and baking for tension coating formation. Subsequently, the sample pieces were subjected to the second stress relief annealing at 800° C. for 2 hours.

The iron loss reduction effect obtained by imparting tension and moisture absorption resistance of the samples thus obtained were examined. The iron loss reduction effect was evaluated based on magnetic properties measured using an SST (Single Sheet Test) tester (single sheet magnetism tester). Measurement of magnetic properties was performed for each sample right before applying the treatment solution for tension coating, after baking for tension coating formation, and right after subjecting the samples to the second stress relief annealing.

Moisture absorption resistance was evaluated by performing an elution test of phosphorus. Three sample pieces for using in the elution test were prepared by cutting steel sheets right after baking for tension coating formation into a size of 50 mm×50 mm. These sample pieces for the elution test were boiled in distilled water at 100° C. for 5 minutes, and the amounts of phosphorus eluted during the process were measured. Based on the amount of eluted phosphorus, the solubility of tension coating to water can be determined.

Table 1 shows the measurement results of magnetic properties and elution amounts of phosphorus.

The criteria in the table are as follows.

- $B_8$ (R) before application: magnetic flux density right before application of treatment solution for tension coating
- ΔB after application=$B_8$ (C)−$B_8$ (R) where $B_8$ (C): magnetic flux density right after baking for tension coating formation
- ΔB after stress relief annealing=$B_8$ (A)−$B_8$ (R) where $B_8$ (A): magnetic flux density right after second stress relief annealing
- $W_{17/50}$ (R) before application: iron loss right before application of treatment solution for tension coating
- ΔW after application=$W_{17/50}$ (C)−$W_{17/50}$ (R) where $W_{17/50}$ (C): iron loss right after baking for tension coating formation
- ΔW after stress relief annealing=$W_{17/50}$ (A)−$W_{17/50}$ (R) where $W_{17/50}$ (A): iron loss right after second stress relief annealing
- Elution amount of phosphorus: amount measured right after baking for tension coating formation
- Coating appearance: degree of transparency of coating after stress relief annealing determined by visual observation From the experimental results presented in Table 1, it can be seen that by adding phosphoric acid and reducing $Mg^{2+}$/P, it is possible to suppress crystallization when adding a large amount of Ti, and both iron loss and moisture absorption resistance can be improved.

Reasons for limitations on the features of the disclosure will be explained below.

The steel types of the steel sheets contemplated herein are not particularly limited as long as they are grain oriented electrical steel sheets. Generally, such grain oriented electrical steel sheets are produced by subjecting silicon-containing steel slabs to hot rolling with a known method to obtain hot rolled steel sheets, subjecting the hot rolled steel sheets to cold rolling once or multiple times with intermediate annealing performed therebetween to obtain cold rolled steel sheets with final sheet thickness, subjecting the cold rolled steel sheets to primary recrystallization annealing, applying an annealing separator thereon, and then subjecting the cold rolled steel sheets to final annealing.

Regarding the insulating coating treatment liquid components, one or more of a Mg phosphate, Ca phosphate, Ba phosphate, Sr phosphate, Zn phosphate, Al phosphate, and Mn phosphate are used as the phosphate.

While it is normal to use one of the above phosphates, two or more of them may be mixed and used to precisely control the property values of the insulating coating. As the phosphate, primary phosphate (biphosphate) is easily available and is therefore preferable. Since phosphates of alkali metal (Li, Na or the like) significantly deteriorate the moisture absorption resistance of the coating, they are unsuitable.

Colloidal silica is contained in the treatment solution in the amount of 50 parts by mass to 120 parts by mass per 100 parts by mass of the above phosphate in terms of solid content of $SiO_2$. Colloidal silica has an effect of reducing the thermal expansion coefficient of the coating. However, if the content of colloidal silica is less than 50 parts by mass, the effect of reducing the thermal expansion coefficient is limited, and sufficient tension cannot be imparted to the steel sheet. As a result, a sufficient iron loss reduction effect cannot be obtained by forming a tension coating. By contrast, if the content exceeds 120 parts by mass, not only will the coating easily crystallize during baking, but the moisture absorption resistance of the coating will decrease as well.

Further, the treatment solution described herein contains a Ti source in an amount of 30 parts by mass to 50 parts by mass to 100 parts by mass of the above phosphate in terms of $TiO_2$. If the content of the Ti source is less than 30 parts by mass, the moisture absorption resistance of the coating deteriorates. By contrast, if the content exceeds 50 parts by mass, it becomes difficult to prevent crystallization even if phosphoric acid is added to control M/P.

Further, the treatment solution described herein contains phosphoric acid ($H_3PO_4$). In the disclosure, it is important that the number of moles of metallic elements in the phos-

TABLE 1

| No. | additive amount of 85% orthophosphoric acid (ml) | $Mg^{2+}$/P | $B_8$ (R) before application (T) | ΔB after application annealing (T) | ΔB after stress relief (T) | $W_{17/50}$ (R) before application (W/kg) | ΔW after application (W/kg) | ΔW after stress relief annealing (W/kg) | elution amount of P (μg/150 cm$^2$) | coating appearence |
|---|---|---|---|---|---|---|---|---|---|---|
| 1 | 0 | 0.50 | 1.910 | −0.010 | −0.009 | 0.832 | −0.032 | 0.035 | 80 | clouded |
| 2 | 1 | 0.45 | | −0.010 | −0.009 | | −0.030 | −0.035 | 80 | transparent |
| 3 | 5 | 0.33 | | −0.010 | −0.009 | | −0.031 | −0.032 | 80 | transparent |

phate and the number of moles of phosphorus contained in the treatment solution satisfy the relation of formula (1).

$$0.20 \leq ([Mg]+[Ca]+[Ba]+[Sr]+[Zn]+[Mn]+1.5[Al])/[P] \leq 0.45 \quad (1)$$

Here, each symbol of element shown in square brackets in formula (1) represents the number of moles of the element contained in the treatment solution for chromium-free tension coating. The number of moles of metallic elements which are not added to the treatment solution as phosphate is regarded as zero. The coefficient for [Al] is 1.5 due to the fact that, while metallic elements other than Al are bivalent, Al is trivalent. Hereinafter, the middle part of the above formula i.e. ([Mg]+[Ca]+[Ba]+[Sr]+[Zn]+[Mn]+1.5 [Al])/[P] will be referred to as "M/P".

When M/P is less than 0.20, the P in the coating is excessive and therefore the elution amount of phosphorus from the coating increases, and the moisture absorption resistance decreases. On the other hand, if M/P is over 0.45, it is not possible to contain Ti of an amount required to obtain a sufficient moisture absorption resistance without causing crystallization in the coating.

As the Ti source to be contained in the treatment solution for the chromium-free tension coating described herein, $TiO_2$ sol is preferable in terms of availability, costs and the like. Although the $TiO_2$ sol may be acidic, neutral or alkaline, pH is preferably 5.5 to 12.5.

Further, it is preferable for the $TiO_2$ sol to contain titanium phosphate in a solid mass ratio of 0.1% to 50% with respect to $TiO_2$. By adding titanium phosphate, the dispersibility of $TiO_2$ particles can be enhanced. Further, titanium phosphate has the effect of enhancing the compatibility between $TiO_2$ and phosphate and enhancing the stability of the coating liquid. With a titanium phosphate content of less than 0.1%, the effect of enhancing compatibility is poor. On the other hand, titanium phosphate content exceeding 50% leads to an increase in costs. The amount of phosphoric acid in the treatment solution in formula (1) is the total amount of phosphoric acid in the treatment solution and this includes the amount of phosphoric acid added as titanium phosphate.

Further, fine powdery inorganic mineral particles such as silica and alumina can be added to the treatment solution described herein. These inorganic mineral particles are effective for improving sticking resistance of the coating. The content of the inorganic mineral particles is preferably 1 part by mass with respect to 20 parts by mass of colloidal silica at most in order to prevent a decrease in the stacking factor.

The above treatment solution is applied to the surface of the electrical steel sheet and then baked to form tension coating. The total coating amount of both sides of the steel sheet after drying the coating is preferably 4 $g/m^2$ to 15 $g/m^2$. This is because if the coating amount is less than 4 $g/m^2$, the interlaminar resistance decreases, whereas if it is more than 15 $g/m^2$, the stacking factor decreases. In the examples described herein, coating is formed so that the coating amount is substantially the same on both sides. However, when laminating steel sheets to form an iron core, such steel sheets are normally laminated in a manner that the front side and the back side are in contact with each other. Therefore, it is not necessary for the coating amounts of the front and back sides to be equal and there may be a difference between the coating amounts of the front and back sides.

The baking treatment for tension coating formation may be performed for the purpose of flattening annealing. The baking treatment is performed in a temperature range of 800° C. to 1000° C. for a soaking time of 10 seconds to 300 seconds. If the temperature is too low or the soaking time is too short, the flattening will be insufficient. As a result, shape failure is caused and leads to a decrease in yield. On the other hand, if the temperature is too high, the effect of flattening annealing becomes excessive and therefore causes creep deformation of the steel sheet to deteriorate magnetic properties.

EXAMPLES

Example 1

Grain oriented electrical steel sheets subjected to final annealing with sheet thickness of 0.23 mm were prepared. The magnetic flux density $B_8$ of the grain oriented electrical steel sheets at this time was 1.912 T. The grain oriented electrical steel sheets were subjected to pickling in phosphate acid and then chromium-free tension coating was formed on the surfaces thereof. For the formation of the tension coating, treatment solutions for chromium-free tension coating of various compositions shown in Table 2 were used. The treatment solutions were applied on both sides of the grain oriented electrical steel sheets so that the total coating amounts of both sides after drying at 300° C. for 1 minute were 10 $g/m^2$. Then, in an atmosphere of $N_2$: 100%, baking treatment was performed at 850° C. for 30 seconds. Then, the steel sheets were subjected to stress relief annealing in an atmosphere of $N_2$: 100% at 800° C. for 2 hours.

As phosphate, primary phosphate solutions were used for each sample. The amounts of the phosphate in terms of solid content are shown in Table 2. As Ti source, $TiO_2$ sol TKS-203 manufactured by Tayca Corporation was used. As phosphoric acid, an 85% phosphoric acid solution was used.

The results of examining the characteristics of the grain oriented electrical steel sheets thus obtained are shown in Table 3.

The evaluation of each characteristic was performed in the following way.

- $W_{17/50}$ (R) before application: iron loss right before application of treatment solution for tension coating
- $\Delta W$ after application=$W_{17/50}$ (C)−$W_{17/50}$ (R) where $W_{17/50}$ (C): iron loss right after baking for tension coating formation
- $\Delta W$ after stress relief annealing=$W_{17/50}$ (A)−$W_{17/50}$ (R) where $W_{17/50}$ (A): iron loss right after stress relief annealing
- Elution amount of phosphorus: three sample pieces with a size of 50 mm×50 mm and a coating surface area of 150 $cm^2$ were boiled in distilled water at 100° C. for 5 minutes and then examined
- Coating appearance: degree of transparency of coating after stress relief annealing determined by visual observation

TABLE 2

| No. | phosphate in terms of solid content (g) | | | | | | | colloidal silica in terms of solid content of $SiO_2$ (g) | $TiO_2$ sol in terms of solid content of $TiO_2$ (g) | 85% ortho-phosphoric acid (ml) | M/P | remarks |
|---|---|---|---|---|---|---|---|---|---|---|---|---|
| | magnesium phosphate | calsium phosphate | barium phosphate | strontium phosphate | zinc phosphate | aluminum phosphate | manganese phosphate | | | | | |
| 1 | 100 | — | — | — | — | — | — | 60 | 40 | 0 | 0.50 | comparative example |
| 2 | 100 | — | — | — | — | — | — | 60 | 40 | 4 | 0.44 | example |
| 3 | 70 | — | — | — | — | — | 30 | 60 | 40 | 10 | 0.38 | example |
| 4 | 80 | 20 | — | — | — | — | — | 60 | 40 | 20 | 0.31 | example |
| 5 | 100 | — | — | — | — | — | — | 60 | 40 | 40 | 0.22 | example |
| 6 | 100 | — | — | — | — | — | — | 60 | 40 | 60 | 0.17 | comparative example |
| 7 | 100 | — | — | — | — | — | — | 50 | 25 | 10 | 0.38 | comparative example |
| 8 | 100 | — | — | — | — | — | — | 50 | 30 | 10 | 0.38 | example |
| 9 | 50 | — | — | — | — | 50 | — | 50 | 35 | 10 | 0.38 | example |
| 10 | 50 | — | — | — | 50 | — | — | 50 | 40 | 10 | 0.37 | example |
| 11 | 100 | — | — | — | — | — | — | 50 | 50 | 10 | 0.38 | example |
| 12 | 100 | — | — | — | — | — | — | 50 | 60 | 10 | 0.38 | comparative example |
| 13 | 100 | — | — | — | — | — | — | 50 | 60 | 40 | 0.22 | comparative example |
| 14 | — | — | — | — | — | 100 | — | 40 | 40 | 20 | 0.31 | comparative example |
| 15 | 60 | — | — | — | — | 40 | — | 100 | 40 | 20 | 0.31 | example |
| 16 | 100 | — | — | — | — | — | — | 120 | 40 | 20 | 0.31 | example |
| 17 | 100 | — | — | — | — | — | — | 140 | 40 | 20 | 0.31 | comparative example |
| 18 | — | 30 | — | — | — | — | 70 | 50 | 35 | 10 | 0.37 | example |
| 19 | — | 50 | — | — | — | 50 | — | 50 | 35 | 10 | 0.38 | example |
| 20 | — | — | 100 | — | — | — | — | 50 | 35 | 10 | 0.34 | example |
| 21 | — | — | — | 100 | — | — | — | 50 | 35 | 10 | 0.36 | example |
| 22 | — | — | — | — | 100 | — | — | 50 | 35 | 10 | 0.37 | example |

TABLE 3

| No. | $W_{17/50}$ (R) before application (W/kg) | ΔW after application (W/kg) | ΔW after stress relief annealing (W/kg) | elution amount of phosphorous (μg/150 $cm^2$) | coating appearance | remarks |
|---|---|---|---|---|---|---|
| 1 | 0.840 | −0.029 | −0.001 | 80 | clouded (crystalized) | comparative example |
| 2 | | −0.031 | −0.029 | 82 | transparent | example |
| 3 | | −0.032 | −0.030 | 85 | transparent | example |
| 4 | | −0.029 | −0.026 | 85 | transparent | example |
| 5 | | −0.033 | −0.031 | 87 | transparent | example |
| 6 | | −0.031 | −0.031 | 500 | transparent | comparative example |
| 7 | | −0.034 | −0.033 | 350 | transparent | comparative example |
| 8 | | −0.028 | −0.028 | 68 | transparent | example |
| 9 | | −0.028 | −0.027 | 75 | transparent | example |
| 10 | | −0.035 | −0.033 | 58 | transparent | example |
| 11 | | −0.012 | −0.010 | 63 | transparent | example |
| 12 | | −0.035 | 0.002 | 60 | clouded (crystalized) | comparative example |
| 13 | | −0.038 | −0.002 | 52 | clouded (crystalized) | comparative example |
| 14 | | −0.001 | 0.000 | 56 | transparent | comparative example |
| 15 | | −0.035 | −0.035 | 60 | transparent | example |
| 16 | | −0.018 | −0.032 | 70 | transparent | example |
| 17 | | −0.005 | 0.000 | 80 | clouded (crystalized) | comparative example |
| 18 | | −0.033 | −0.029 | 70 | transparent | example |
| 19 | | −0.033 | −0.030 | 65 | transparent | example |
| 20 | | −0.028 | −0.030 | 75 | transparent | example |
| 21 | | −0.028 | −0.032 | 73 | transparent | example |
| 22 | | −0.032 | −0.029 | 76 | transparent | example |

As shown in Tables 2 and 3, by using the treatment solutions satisfying the conditions of the disclosure, chromium-free tension insulating coating, a small elution amount of phosphorus and excellent moisture absorption resistance and good appearance could be obtained.

Example 2

Grain oriented electrical steel sheets subjected to final annealing with sheet thickness of 0.23 mm were prepared. The magnetic flux density $B_8$ of the grain oriented electrical steel sheets at this time was 1.912 T. The grain oriented electrical steel sheets were subjected to pickling in phosphate acid and then chromium-free tension coating was formed on the surfaces thereof. For the formation of the tension coating, treatment solutions containing 100 g of primary magnesium phosphate in terms of solid content as phosphate with the other components being various compositions shown in Table 4 were used. The treatment solutions were applied on the surfaces of the grain oriented steel sheets so that the total coating amount of both sides after drying at 300° C. for 1 minute were 15 g/m$^2$. Then, in an atmosphere of $N_2$: 100%, baking treatment was performed at 950° C. for 10 seconds. Then, the steel sheets were subjected to stress relief annealing in an atmosphere of $N_2$: 100% at 800° C. for 2 hours.

The results of examining the characteristics of the grain oriented electrical steel sheets thus obtained are shown in Table 5.

The evaluation of each characteristic was conducted with the same method as example 1.

TABLE 4

| | Ti source and additive amount thereof in terms of $TiO_2$ (g) | | | | | | colloidal silica in terms of solid content of $SiO_2$ | 85% orthophosphoric acid | | |
|---|---|---|---|---|---|---|---|---|---|---|
| No. | $Ti(OH)_4$ | $TiOCl_2$ | $Ti_2(SO_4)_3$ | $TiSO_4$ | $[(OH)_2Ti(C_3H_5O_3)]^{2-}(NH_4^+)_2$ | $TiPO_4$ | (g) | (ml) | M/P | remarks |
| 1 | 20 | — | — | — | — | — | 80 | 4 | 0.44 | comparative example |
| 2 | 40 | — | — | — | — | — | 80 | 10 | 0.38 | example |
| 3 | 50 | — | — | — | — | — | 80 | 10 | 0.38 | example |
| 4 | 60 | — | — | — | — | — | 80 | 10 | 0.38 | comparative example |
| 5 | — | 30 | — | — | — | — | 60 | 10 | 0.38 | example |
| 6 | — | — | 30 | — | — | — | 60 | 10 | 0.38 | example |
| 7 | — | — | — | 10 | — | — | 50 | 10 | 0.38 | comparative example |
| 8 | — | — | — | 30 | — | — | 50 | 10 | 0.38 | example |
| 9 | — | — | — | — | 5 | — | 50 | 10 | 0.38 | comparative example |
| 10 | — | — | — | — | 30 | — | 50 | 10 | 0.38 | example |
| 11 | — | — | — | — | 30 | 30 | 50 | 10 | 0.34 | example |

TABLE 5

| No. | $W_{17/50}$ (R) before application (W/kg) | ΔW after application (W/kg) | ΔW after stress relief annealing (W/kg) | elution amount of P (μg/150 cm$^2$) | coating appearance | remarks |
|---|---|---|---|---|---|---|
| 1 | 0.840 | −0.024 | −0.025 | 250 | transparent | comparative example |
| 2 | | −0.031 | −0.029 | 82 | transparent | example |
| 3 | | −0.028 | −0.029 | 85 | transparent | example |
| 4 | | −0.002 | 0.000 | 78 | clouded (crystalized) | comparative example |
| 5 | | −0.024 | −0.031 | 87 | transparent | example |
| 6 | | −0.031 | −0.031 | 83 | transparent | example |
| 7 | | −0.031 | −0.030 | 520 | transparent | comparative example |
| 8 | | −0.026 | −0.028 | 68 | transparent | example |
| 9 | | −0.028 | −0.028 | 690 | transparent | comparative example |
| 10 | | −0.029 | −0.028 | 58 | transparent | example |
| 11 | | −0.030 | −0.030 | 61 | transparent | example |

As shown in Tables 4 and 5, by using the treatment solutions satisfying the conditions of the disclosure, chromium-free tension insulating coating with a small elution amount of phosphorus, excellent moisture absorption resistance and good appearance could be obtained.

INDUSTRIAL APPLICABILITY

According to the disclosure, it is possible to prevent crystallization of the coating which occurs when adding Ti for the purposes of improving moisture absorption resistance of the chromium-free tension coating. As a result, it is possible to avoid the adverse effect of the reduction in the tension imparted to the steel sheet and add a sufficient amount of Ti. Therefore, by using the treatment solution described herein, chromium-free tension coating with excellent moisture absorption resistance and iron loss improving effect can be obtained.

Further, by coating the above chromium-free tension coating, grain oriented electrical steel sheets with excellent moisture absorption resistance and low iron loss can be obtained.

The invention claimed is:

1. A grain oriented electrical steel sheet with chromium-free tension coating obtained by applying a treatment solution on a surface of a grain oriented electrical steel sheet subjected to final annealing and performing baking treatment at a temperature of 800° C. or higher and 1000° C. or lower for 10 seconds to 300 seconds, wherein the treatment solution comprises:

one or more of a Mg phosphate, Ca phosphate, Ba phosphate, Sr phosphate, Zn phosphate, Al phosphate, and Mn phosphate;

colloidal silica in an amount of 50 parts by mass to 120 parts by mass per 100 parts by mass of the one or more phosphates in terms of solid content of $SiO_2$;

Ti source in an amount of 30 parts by mass to 50 parts by mass per 100 parts by mass of the one or more phosphates in terms of solid content of $TiO_2$; and $H_3PO_4$, and the number of moles of metallic elements in the one or more phosphates and the number of moles of phosphorus in the treatment solution satisfy the relation of formula (1)

$$0.20 \leq ([Mg]+[Ca]+[Ba]+[Sr]+[Zn]+[Mn]+1.5[Al])/[P] \leq 0.45 \quad (1)$$

where each symbol of element shown in square brackets represents the number of moles of the element contained in the treatment solution.

2. The grain oriented electrical steel sheet with chromium-free tension coating according to claim 1, wherein the Ti source contains $TiO_2$ sol.

3. The grain oriented electrical steel sheet with chromium-free tension coating according to claim 2, wherein the Ti source further contains titanium phosphate in a solid mass ratio of 0.1% to 50% with respect to $TiO_2$ in the $TiO_2$ sol.

* * * * *